US009330639B1

(12) United States Patent
Armstrong

(10) Patent No.: US 9,330,639 B1
(45) Date of Patent: May 3, 2016

(54) ADJUSTABLE PITCH STOP FOR THE TREMOLO BAR OF AN ELECTRIC GUITAR

(71) Applicant: Dennis Armstrong, Brick, NJ (US)

(72) Inventor: Dennis Armstrong, Brick, NJ (US)

( * ) Notice: Subject to any disclaimer, the term of this patent is extended or adjusted under 35 U.S.C. 154(b) by 0 days.

(21) Appl. No.: 14/756,007

(22) Filed: Jul. 20, 2015

(51) Int. Cl.
*G10D 3/14* (2006.01)

(52) U.S. Cl.
CPC ..... *G10D 3/146* (2013.01)

(58) Field of Classification Search
CPC ..... G10D 3/146; G10D 3/14; G10D 3/143; G10D 1/00
USPC ..... 84/313, 290
See application file for complete search history.

(56) References Cited

U.S. PATENT DOCUMENTS 5,390,579 A * 2/1995 Burgon ..... G10D 3/14 84/297 R
5,419,227 A * 5/1995 Lavineway ..... G10D 3/146 84/313

* cited by examiner

*Primary Examiner* — Kimberly Lockett
(74) *Attorney, Agent, or Firm* — Clifford G. Frayne

(57) ABSTRACT

An adjustable pitch stop for a tremolo bar of an electric guitar, the adjustable pitch stop having a generally C-clamp or U-shaped clamp and set screw to secure the pitch stop to the tremolo bar, the C-clamp having a tubular member attached thereto, there being a threaded male member slidably secured through the tubular member, the threaded male member having an adjustment knob positioned at one end to adjust the positioning of the male threaded member, the male threaded member having a stop member at the opposing end for contact with the body of the electric guitar, the being interposed between the adjustment knob and the tubular member, a first locking nut, there being disposed a second locking nut and biasing component secured between the stop member and the tubular member allowing the presetting of two descending notes.

12 Claims, 5 Drawing Sheets

ADJUSTABLE PITCH STOP FOR THE TREMOLO BAR OF AN ELECTRIC GUITAR

BACKGROUND OF THE INVENTION

1. Field of the Invention

The present invention relates to electric guitars, and in particular, electrical guitars which employ a tremolo bar which acts as a spring tensioning system to tension the guitar strings of an electric guitar, and to a removable pitch stop attached to the tremolo bar which allows the musician to limit the downward travel of the tremolo bar, to stop on one of two pre-adjusted, pre-tuned notes of the musician's choice.

2. Description of the Prior Art

Electric guitars are very popular and a variety of electric apparatus have been developed which allow for the sound modification of electric guitars. This allows musicians to create sounds that were previously obtainable only in recording studios or through the use of very expensive sound equipment.

Applicant's invention is a removable add-on device which is securable to the tremolo bar of an electric guitar. An electric guitar normally has six strings, and these strings can be secured to a bridge at the end of the guitar, or a spring tensioning system in the form of a tremolo system which serves to provide tension to the six strings of the guitar. The spring tensioning of the tremolo bar is designed and is supposed to apply equal tension to the guitar strings. In use, the tremolo bar can be pushed down or toward the body of the electric guitar to cause a particular note to descend and the tremolo bar can also be pulled up, away from the body, to make the note rise depending on the musicians desire. The movement of the tremolo bar affects the tensioning of the strings of the electric guitar.

Applicant's pitch stop is removably securable to the tremolo bar and adjusts the tremolo bar's movement which allows the musician to pretune two notes by fixing and controlling the descending movement of the tremolo bar to the desired notes which the musician wishes when the tremolo bar is activated in one of two methods.

OBJECTS OF THE INVENTION

An object of the present invention is to provide for a novel pitch stop removably securable to the tremolo bar of an electric guitar which allows the musician to limit the descending tremolo bar travel.

A still further object of the present invention is to provide for a novel pitch stop for the tremolo bar of an electric guitar in which the pitch stop device can remain secured to the tremolo bar, but pivoted out of position when not in use.

A still further object of the present invention is to provide for a novel pitch stop for the tremolo bar of an electric guitar which allows the musician to pretune two separate notes to achieve the descending note that the musician seeks in a rapid manner.

A still further object of the present invention is to provide a novel pitch stop for the tremolo bar of an electric guitar which allows the musician to preset two descending notes.

SUMMARY OF THE INVENTION

An adjustable pitch stop for a tremolo bar of an electric guitar, the adjustable pitch stop having a generally C-shaped clamp or U-shaped clamp and set screw to secure the pitch stop to the tremolo bar, the C-clamp having a non-threaded, smooth bore tubular member attached thereto, there being a threaded male member slidably secured through the smooth bore tubular member, the threaded male member having an adjustment knob positioned at one end to adjust the positioning of the male threaded member, the male threaded member having a stop member at the opposing end for contact with the body of the electric guitar, there being a first locking nut interposed between the adjustment knob and the smooth bore tubular member, and a second locking member interposed with a biasing means between the smooth bore tubular member and the stop member to allow the tremolo bar to be depressed two different preset distances to achieve one of two different preset notes.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
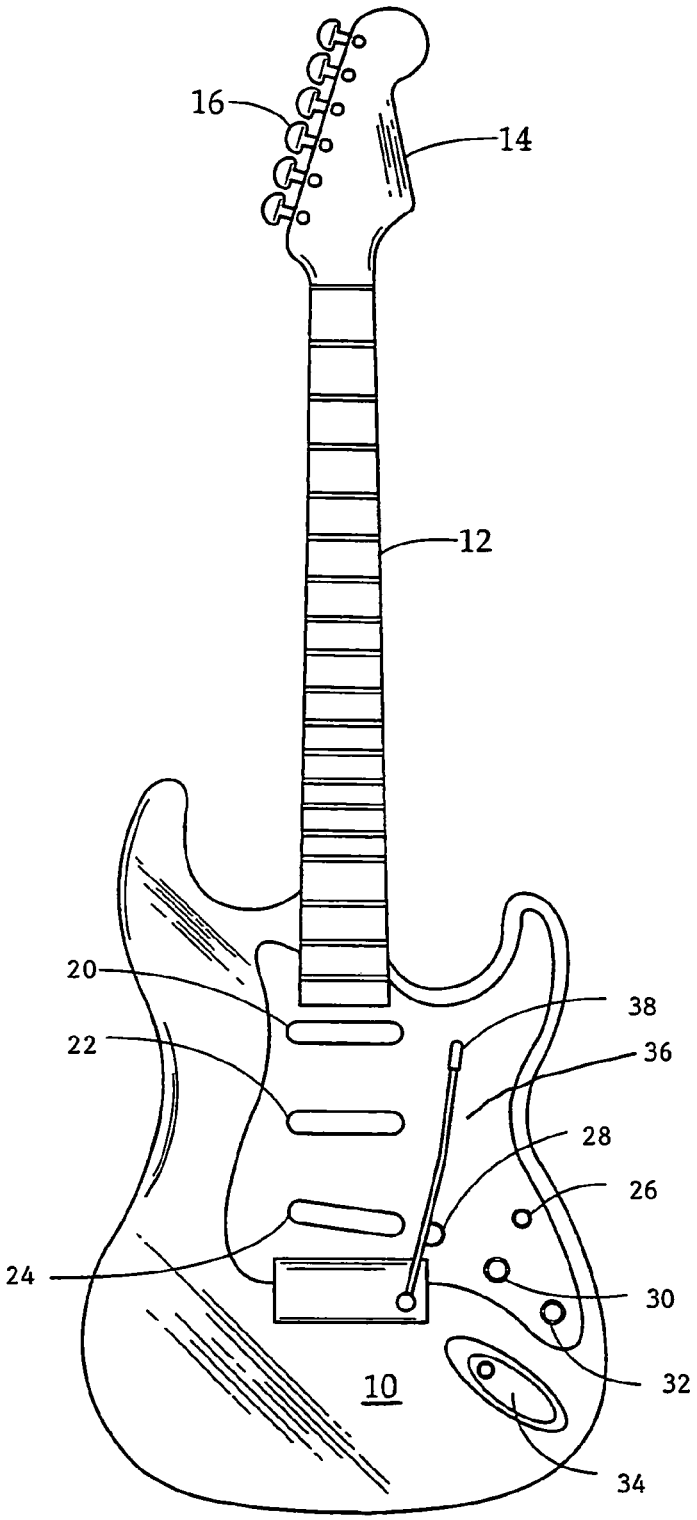
FIG. 1 PRIOR ART
FIG. 1 is a front view of a typical electric guitar with tremolo bar of the prior art.

FIG. 1 is a front view of a typical electric guitar. It consists of a body 10, neck 12, head stock 14, tensioners 16, and a plurality of strings, the strings extending from the tensioners 16 on the neck 12, to the body of the guitar. The guitar body would also include a plurality of pick ups which in FIG. 1 are depicted with three pick ups, 20, 22, and 24. Additionally, the electric guitar would contain a selector switch 26 and a volume dial 28 and tone dials 30 and 32, and a signal output receptacle 34 into which the electrical conduit from an amplifier is plugged. The guitar depicted in FIG. 1 also contains a tremolo bar 36.

The strings which would extend from the tensioners 16 down along neck 12, would sometimes be secured to a bridge of the guitar located on the lower side of the pick ups 20, 22, and 24. This bridge is often times replaced by a tremolo system and securing apparatus on the electric guitar illustrated in FIG. 1. The tremolo bar 36 is a stringed tension device with a spring tension equaling the guitar string tension. The tremolo bar 36 is moveable downwardly or towards the body of the guitar (descending) and upwardly or away from the body of the guitar (ascending). By pushing down on the tremolo bar 36, the musician can strike a descending note and when pulling up on the tremolo bar, the musician can strike an ascending note.

A standard electric guitar would normally have six strings, and when pushing down on the tremolo bar 36, towards the body 10 of the guitar, the six strings or notes do not necessarily descend equally or stay in tune with each other. The same also occurs when one pulls up or away from the body 10 of the guitar with the tremolo bar. As such, songs or scales created for the tremolo bar 36 and the descending or ascending notes, are most successful when using only one or two strings of the six stringed guitar at one time. Applicant's invention is directed to presetting two separate descending notes on the same string when the tremolo bar is pushed downwardly towards the guitar.

Figure 2:
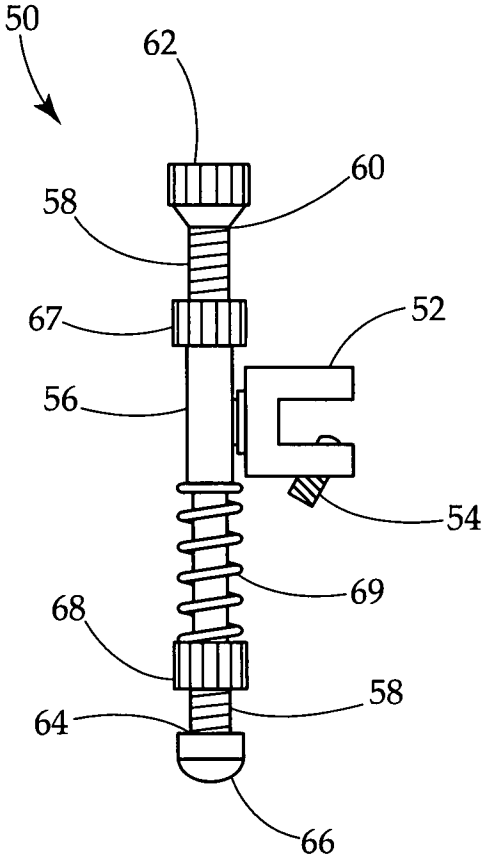
FIG. 2 is a side view of a pitch stop of the present invention.

FIG. 2 is a side view of a pitch stop 50 of the present invention. Pitch stop 50 includes a securing component in the form of a U-shaped or C-shaped clamp 52 which would engage end of tremolo bar 36 (see FIG. 1). The C-shaped clamp 52 would be tightened by means of a set screw 54. Secured to the C-shaped clamp 52 would be a non-threaded smooth bore tubular member 56. Passing slidably through smooth bore tubular member would be an exteriorly threaded male member 58 having an upper end 60 having rigidly secured thereto an adjusting knob 62 illustrated with a knurled circumferential surface for grip purposed, utilized to rotate the male exteriorly threaded member 58. Opposing end 64 of the male exteriorly threaded member 58 would have a stop member 66 for contact with the body 10 of the electric guitar. Interposed between the adjustment knob 62 and smooth bore tubular member 56, would be first locking nut 67 which would lock the exteriorly threaded male member in position once the musician had accomplished the tuning of a first preset note. The rotation of the adjustment knob 62, causes the male exteriorly threaded member 58 to extend or be retracted through first locking nut 67, which is held secure by the musician while rotating the adjustment knob, thus affecting and setting the distance of stop member 66, from the smooth bore tubular member 56.

Disposed beneath smooth bore tubular member 56 and between stop member 66 is a second locking nut 68 and disposed between second locking nut 68 and smooth bore tubular member 56 is a biasing component in the form of a coiled spring 69. Second locking nut 68 and biasing component 69 in cooperation with stop member 66 and smooth bore tubular member 56 allows the musician to preset a second descending note on the guitar by holding the second locking nut secure while rotating the adjustment knob.

As described hereafter, this is accomplished by supplying direct pressure to the tremolo bar which would through C-shaped clamp 52 and smooth bore tubular member 56 transmit that downward pressure against biasing means 69 a distance dependent upon the presetting of second locking nut 68. To obtain the first preset note, the musician would apply downward pressure to adjustment knob 62 which in turn through first locking nut 67 would cause the entire pitch stop and attached tremolo bar to descend such that there would be no compressive action on biasing means 69.

Figure 3:
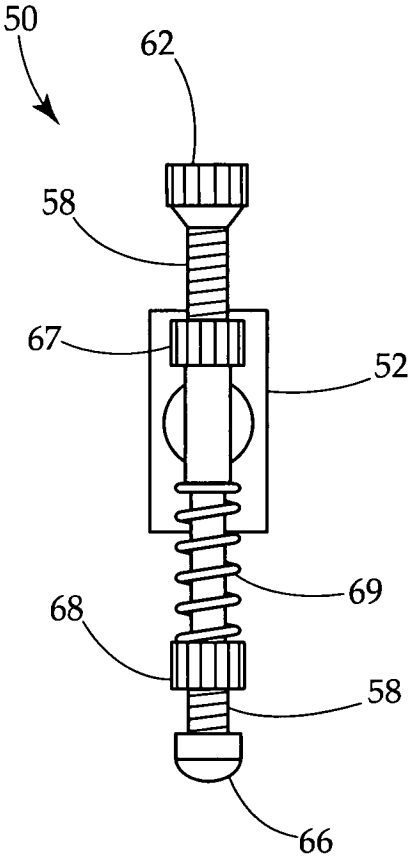
FIG. 3 is a front view of the pitch stop of the present invention illustrating its pivot quality.

FIG. 3 is a front view of a the pitch stop 50 of the present invention illustrating its pivotability which may be desired if the musician wishes to pivot the pitch stop out of position and into parallel relationship with the tremolo bar when it is not in use. FIG. 3 illustrates that the tubular member 56 is rotatably positioned onto C-shaped clamp 52 such that in an operative state as illustrated in FIG. 2, the tubular member 52, together with exteriorly threaded male member 58, would be a perpendicular relationship with the C-shaped clamp and as illustrated in FIG. 3, when not in use, could be pivoted to a parallel relationship.

Figure 4:
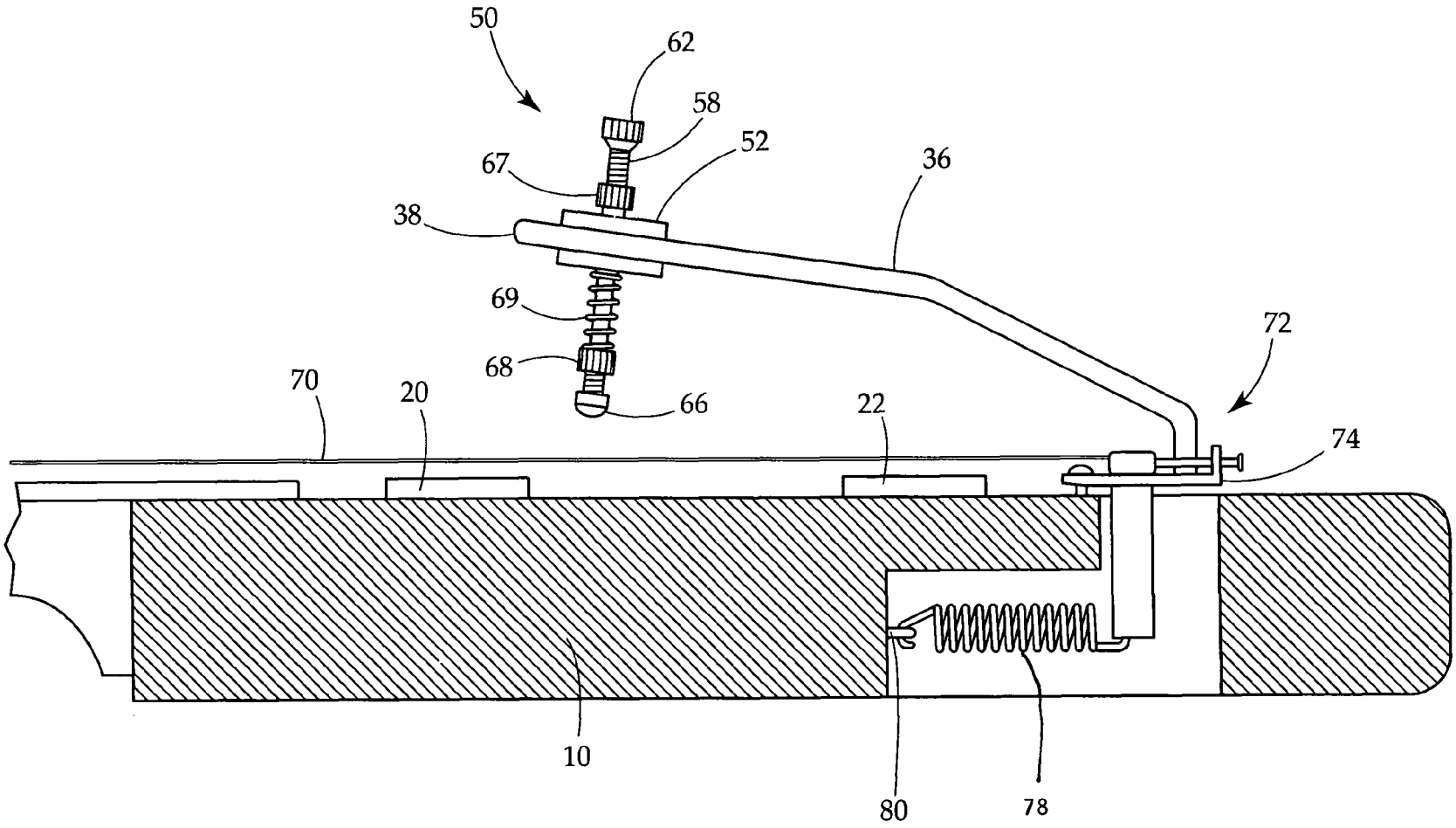
FIG. 4 is a side partial cutaway view of a pitch stop of FIG. 2 of the present invention secured to the tremolo bar of an electric guitar in a neutral, inactivated position.

FIG. 4 is a side, partial cutaway view of the body of a guitar with tremolo bar and with the pitch stop attached. The strings 70 of the guitar extend from the tensioners 16 on the head stock 14 down the neck 12, across the pick ups 20 and 22, and are secured under tension to the tremolo mount 72. The tremolo mount 72 comprises the tremolo bar 36 secured to a first pivoting member 74 to which the various strings 70 of the electric guitar are attached. The first pivot member 74 is connected to a vertical pivot arm 76 extending inwardly into the body 10 of the guitar, where it is secured to a tremolo bar biasing means 78 in the form of a coiled spring secured to the vertical pivoting arm 76, and to the interior 80 of the body 10 of the guitar. In this configuration, if the tremolo bar 36 is moved downwardly, that is towards the body 10 of the electric guitar, the biasing means or spring 78 is extended thus creating less tension on the strings of the guitar. If the tremolo arm is pulled away from the body 10 of the guitar, the amount of tension on the strings is increased because of the pivot mechanism.

Figure 5:
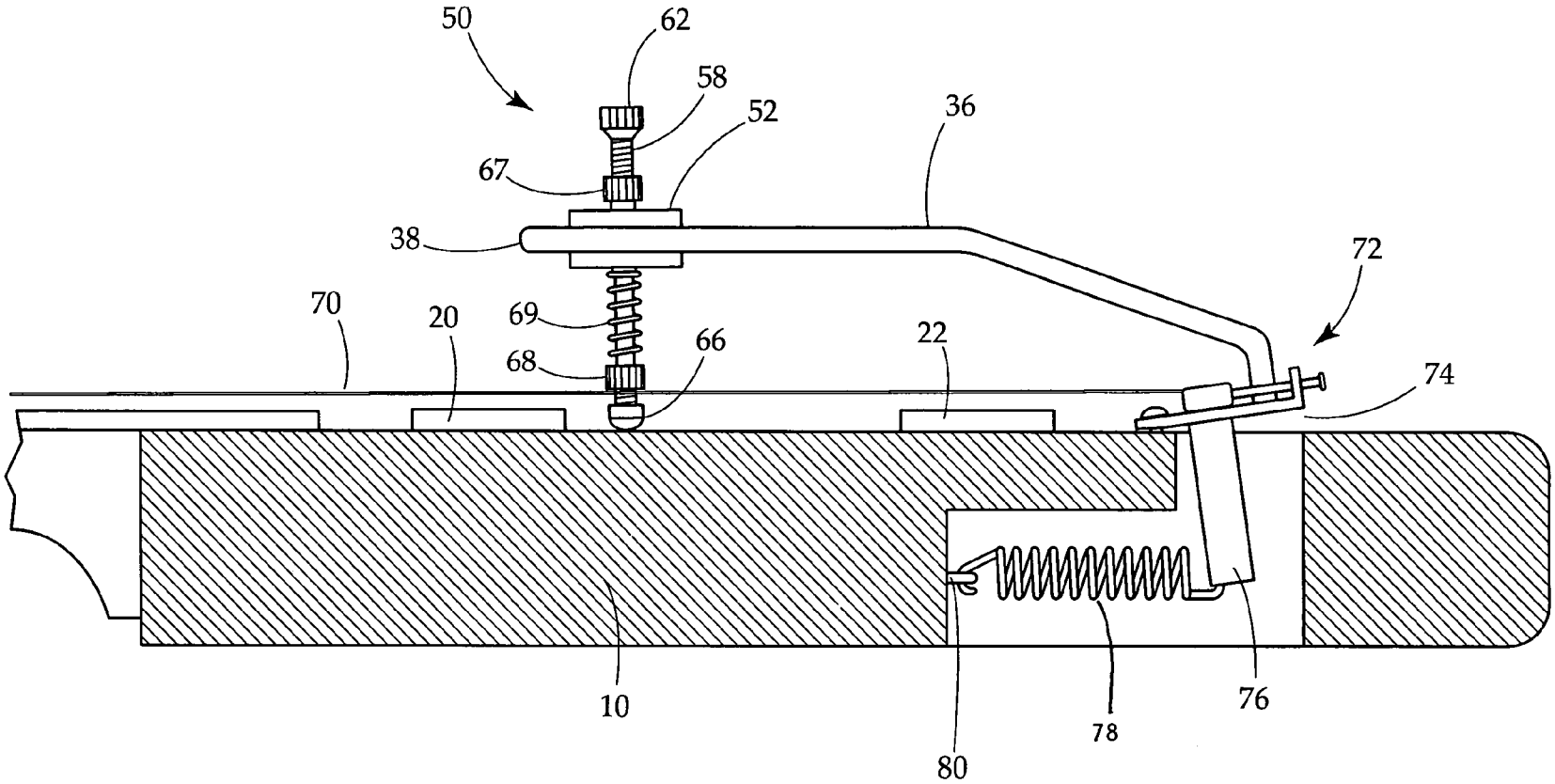
FIG. 5 is a side partial cutaway view of the pitch stop of FIG. 2 of the present invention secured to the tremolo bar of an electric guitar wherein the tremolo bar has been displaced downwardly towards the body of the guitar based on pressure supplied directly to the pitch stop to achieve a first preset note.

FIG. 4 illustrates the tremolo bar 36 with the pitch stop 50 attached thereto in a neutral position, i.e inactivated. FIG. 5 illustrates the pitch stop 50 and tremolo bar 36 in a downward position, i.e. the stop member 66 is in contact with the body 10 of the electric guitar for a first preset descending note. In the activation illustrated in FIG. 5, pressure is applied to adjustment knob 62, which in turn causes tremolo bar 36 to depress towards the body 10 of the guitar, and bring stop member 66 into contact. In applying pressure to the adjustment knob 62, no compression force is applied to the biasing means 69 so that the pitch stop and the tremolo bar move as one. This movement achieves the first preset note established by the musician.

Figure 6:
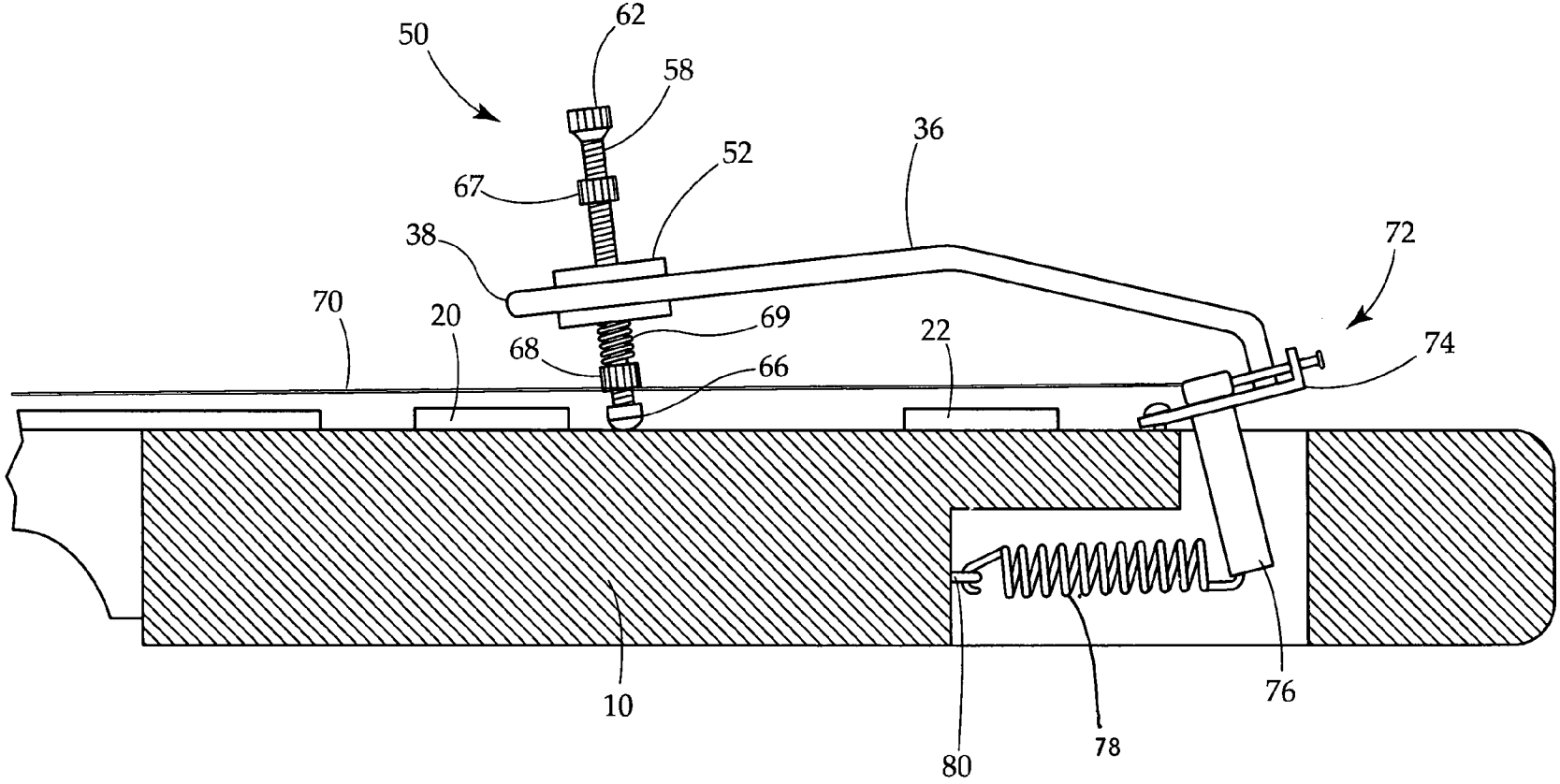
FIG. 6 is a side partial cutaway view of the guitar, tremolo bar, and pitch stop of FIG. 2, wherein the pitch stop and tremolo bar have been displaced downwardly by direct pressure on the tremolo bar achieving a second preset note.

FIG. 6 illustrates the second manner of operation of the pitch stop 50. In this configuration, pressure is not applied to the adjustment knob 62, but rather directly to tremolo bar 36. This compresses the biasing means 69 positioned between C-shaped clamp 52 and second locking nut 68. Second locking nut 68 has been pretuned by the musician so that the compression applied onto the tremolo bar and hence the biasing means, causes stop member 52 to contact the body 10 of the guitar. This achieves the second preset note. It does not upset the first preset note, because first locking nut 67 remains in position and would contact the C-shaped clamp 52 upon release of the pressure on tremolo bar 36.

In this configuration, the musician can hit a note on a particular string of the guitar to determine whether or not the note struck is correct. For example, the musician, while holding the tremolo bar 36 down as illustrated in FIG. 4, and using a tuner, the musician would pluck a string, perhaps to tune the low E to a low A when the tremolo bar is pushed down all the way. In doing this, the musician in conjunction with the tuner can determine if he has the correct note. If not, the musician adjusts the adjustment knob 62 and male exteriorly threaded member 58 while holding first locking nut secure with his fingers to adjust the distance of the stop member 66 of the pitch stop from the C-clamp 52 using first locking nut 67. The musician can either extend the distance or retract the distance by turning the adjustment knob 62 in relation to stationary first locking nut 67. This in conjunction with the tuner and the musician hitting the note, allows the musician to fine tune the string to the exact preset first descending note which he desires. The musician would repeat this action for the second preset descending note by adjusting the location of the stop member in relationship to second locking nut 68 and relationship to C-shaped clamp as tremolo bar 36 is depressed.

The C-shaped clamp or U-shaped clamp of Applicant's pitch stop has application to tremolo bars of varying cross sectional configuration. The majority of tremolo bars are circular in cross section, but specialized tremolo bars are ovoid or rectangular in cross section.

The most common arrangement of a tremolo bar 36 with respect to an electric guitar and its mounting and operation vis-à-vis the strings of the guitar, is commonly referred to as the Floyd Rose system. The system is similar to that which has previously been described, however, the system includes tremolo bars which universally are circular in cross sectional area, and which may or may not have an end piece or knob at their ends 38. However, such knob or end piece is easily removable, leaving a tremolo bar of constant cross section, which would allow a slidable mount having a bore for receipt of a tremolo bar.

In either configuration of the mount, the musician can preset two descending notes. The first locking nut 67 positioned below the adjustment knob 62 is held secure while threaded member 56 is adjusted upwardly or downwardly to control the distance that stop member 66 extends from C-shaped clamp 52. Securing second locking nut 68 while adjusting movement of threaded member 56 will either release tension or increase tension on the biasing means 69. In this manner, the musician can supply pressure to the top of the adjustment knob 62 causing the tremolo bar 36 to move downwardly or descend towards the body of the guitar to achieve the first preset note. The musician can also supply downward pressure directly to the tremolo bar 36, which in turn will move downwardly against biasing means 69 until the biasing means is completely depressed against the position of the lower locking nut 68 and stop member 66 contacts guitar body 10. Thus the musician can preset two descending notes, one by setting the locking nuts 67 and 68, and depressing the tremolo bar 36 utilizing the upper surface of knurled knob 62, or, providing pressure downwardly on tremolo bar 36 directly on the biasing means 69.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An adjustable pitch stop cooperable with a tremolo bar of an electric guitar to preset the desired pitch of two descending notes, the adjustable pitch stop comprising:

a clamp, said clamp securable to a tremolo bar of an electric guitar;

a tubular member mounted to said clamp, said tubular member having a smooth non-threaded interior bore;

a shaft member exteriorly threaded, slidably positioned through said tubular member, said shaft member having a contact stop secured at a first lower end of said shaft member for selective contact with a guitar body, said opposing end of said shaft having an adjustment knob for rotation of said shaft;

a first lock nut disposed on said shaft member between said adjustable knob, and said tubular member for presetting a first distance of descent of said contact stop and said tremolo bar for a first preset descending note;

a second lock nut disposed on said shaft member between said contact stop and said tubular member and a biasing component disposed between said second locking nut and said tubular member for setting a second distance of descent of said tremolo bar for a second preset descending note.

2. The adjustable pitch stop in accordance with claim 1 wherein said tubular member is pivotal with respect to said clamp member to pivot said shaft member from 90 degrees orientation with said tremolo bar, to a substantial parallel orientation with said tremolo bar when said adjustable pitch stop is not in use.

3. The adjustable pitch stop in accordance with claim 1 wherein its operation mode, said adjustable pitch stop is substantially perpendicular to said tremolo bar and said adjustable pitch stop when in a neutral mode is pivotal from 90 degree orientation with said tremolo bar to a substantially parallel orientation with said tremolo bar.

4. The adjustable pitch stop in accordance with claim 1 wherein downward pressure on said adjustment knob descends said first locking nut, said adjustable pitch stop and said tremolo bar, said contact stop contacting said guitar for playing said first preset descending note.

5. The adjustable pitch stop in accordance with claim 1 wherein pressure applied directly to said tremolo bar compresses said biasing component to said second lock nut descending said clamp, said tubular member, and said contact stop to said guitar for playing said second preset descending note.

6. The adjustable pitch stop in accordance with claim 1 wherein said clamp is C-shaped in configuration having an adjustable set screw for securing said clamp and said adjustable pitch stop to said tremolo bar.

7. An adjustable pitch stop for cooperation with a tremolo bar of an electric guitar to obtain a desired pitch of two present descending notes comprising:

an electric guitar comprising a body, a neck, a plurality of tensioners, a plurality of pick ups, a plurality of control members, and a plurality of strings extending from said tensioners to a tremolo bar system for tensioning the strings of said electric guitar, said adjustable pitch stop cooperable with said tremolo bar for controlling and obtaining a desired pitch of two preset notes, the adjustable pitch stop comprising:

a clamp, said clamp securable to a tremolo bar of an electric guitar;

a tubular member mounted to said clamp, said tubular member having a smooth non-threaded interior bore;

a shaft member exteriorly threaded, slidably positioned through said tubular member, said shaft member having a contact stop secured at a first lower end of said shaft member for selective contact with a guitar body, said opposing end of said shaft having an adjustment knob for rotation of said shaft;

a first lock nut disposed on said shaft member between said adjustable knob, and said tubular member for presetting a first distance of descent of said contact stop and said tremolo bar for a first preset descending note;

a second lock nut disposed on said shaft member between said contact stop and said tubular member and a biasing component disposed between said second locking nut and said tubular member for setting a second distance of descent of said tremolo bar for a second preset descending note.

8. The adjustable pitch stop in accordance with claim 7 wherein said tubular member is pivotal with respect to said clamp member to pivot said shaft member from 90 degrees orientation with said tremolo bar, to a substantial parallel orientation with said tremolo bar when said adjustable pitch stop is not in use.

9. The adjustable pitch stop in accordance with claim 7 wherein its operation mode, said adjustable pitch stop is substantially perpendicular to said tremolo bar and said adjustable pitch stop when in a neutral mode is pivotal from 90 degree orientation with said tremolo bar to a substantially parallel orientation with said tremolo bar.

10. The adjustable pitch stop in accordance with claim 7 wherein downward pressure on said adjustment knob descends said first locking nut, said adjustable pitch stop and said tremolo bar, said contact stop contacting said guitar for playing a first preset descending note.

11. The adjustable pitch stop in accordance with claim 7 wherein pressure applied directly to said tremolo bar compresses said biasing component to said second lock nut descending said clamp, said tubular member, and said contact stop to said guitar for playing said second preset descending note.

12. The adjustable pitch stop in accordance with claim 7 wherein said clamp is C-shaped in configuration having an adjustable set screw for securing said clamp and said adjustable pitch stop to said tremolo bar.

* * * * *